United States Patent [19]

Parlman et al.

[11] 4,264,336

[45] Apr. 28, 1981

[54] HALOGENATED SUBSTITUTED FULVENES USEFUL AS FUEL ANTIKNOCK ADDITIVES

[75] Inventors: Robert M. Parlman; Lawrence M. Fodor, both of Bartlesville, Okla.

[73] Assignee: Phillips Petroleum Company, Bartlesville, Okla.

[21] Appl. No.: 79,746

[22] Filed: Sep. 28, 1979

[51] Int. Cl.[3] ..... C10L 1/20

[52] U.S. Cl. ..... 44/79; 252/386

[58] Field of Search ..... 44/79; 260/650 R, 650 F; 252/386

[56] References Cited

PUBLICATIONS

G. Krese and H. Goetz, Chemische Bevchte, 90 (2161–2162), 1957.

*Primary Examiner*—Winston A. Douglas
*Assistant Examiner*—Jacqueline V. Howard

[57] ABSTRACT

The octane quality of a fuel for an internal combustion engine is improved by mixing halogenated substituted fulvenes with the fuel for an internal combustion engine.

25 Claims, No Drawings

HALOGENATED SUBSTITUTED FULVENES USEFUL AS FUEL ANTIKNOCK ADDITIVES

This invention relates to a method for improving the octane quality of unleaded fuels for internal combustion engines. In one aspect this invention relates to halogenated substituted fulvenes as additives to increase the octane number of unleaded fuels for internal combustion engines.

The phase-down of lead in gasoline as required by Federal Law and the Environmental Protection Agency banning of methylcyclopentadienyl manganese tricarbonyl from use in unleaded gasoline has given added impetus to increase the octane number of unleaded fuels for internal combustion engines either by improvements in refinery processing or by the use of ashless antiknock additives particularly those containing only carbon, hydrogen, nitrogen, and/or oxygen. Many nitrogen compounds, which exhibit excellent antiknock activity, are not in commercial use because of alleged carcinogenicity or formation of nitrous oxide combustion products. One type of non-nitrogen-containing compounds that has antiknock activity is substituted fulvenes. It is an object of this invention to improve the antiknock activity of unsubstituted fulvenes by halogenating the substituted fulvenes and utilizing the halogenated substituted fulvenes as ashless antiknock additives to increase the octane number of fuels for internal combustion engines to a greater extent than is possible with the use of only substituted fulvenes as the ashless antiknock additives. The halogenated substituted fulvenes are particularly applicable for increasing the octane number of unleaded fuels for internal combustion engines.

In accordance with the present invention, a halogenated substituted fulvene is prepared by any of the methods known in the art. The thus prepared halogenated substituted fulvene is then mixed with a fuel for internal combustion engines to increase the octane number of the fuel for internal combustion engines.

Other objects and advantages of the invention will be apparent from the foregoing brief description of the invention and the claims as well as from the detailed description of the invention which follows.

Octane number as used herein generally refers to the research octane number. However, the invention is applicable to increasing the octane number of a fuel for an internal combustion engine regardless of how the octane number is measured.

Materials useful as fuels in the present invention are any hydrocarbon or mixtures of hydrocarbons which may be employed in internal combustion engines. These mixtures are generally referred to as gasoline base fuels. The invention is particularly applicable to unleaded gasoline base fuels which contain little if any metals and are comprised of varying amounts of paraffins, olefins, cycloparaffins (naphthenes) and aromatics. General specifications for unleaded gasoline base fuels are disclosed in ASTM D 439-56T. These unleaded gasoline base fuels generally contain less than 0.05 weight percent lead. The amount of volatilizing agent employed will vary to meet specific requirements due to the season and location.

The halogenated substituted fulvenes useful as gasoline antiknock compounds in the present invention are characterized by the formula

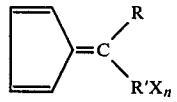

where R can be hydrogen or any hydrocarbyl radical; R′ can be any aromatic radical; X can be any halogen atom, preferably fluorine or chlorine; and n can be 1, 2, or 3. The hydrocarbyl radical will preferably have from 1 to 10 carbon atoms. The aromatic radical will preferably have from 6 to 10 carbon atoms. Some examples of halogenated substituted fulvenes include:

6-methyl-6-(o-fluorophenyl)fulvene
6-methyl-6-(o-chlorophenyl)fulvene
6-methyl-6(m-fluorophenyl)fulvene
6-methyl-6(m-chlorophenyl)fulvene
6-methyl-6(p-fluorophenyl)fulvene
6-methyl-6(p-chlorophenyl)fulvene
6-methyl-6(p-bromophenyl)fulvene
6-methyl-6(p-iodophenyl)fulvene
6-ethyl-6(p-fluorophenyl)fulvene
6-ethyl-6(p-chlorophenyl)fulvene
6-propyl-6(p-fluorophenyl)fulvene
6-propyl-6(p-chlorophenyl)fulvene
6-decyl-6(p-fluorophenyl)fulvene
6-decyl-6(p-chlorophenyl)fulvene
6-cyclohexyl-6(p-fluorophenyl)fulvene
6-cyclohexyl-6(p-chlorophenyl)fulvene
6-phenyl-6(p-fluorophenyl)fulvene
6-phenyl-6(p-chlorophenyl)fulvene
6-(2-propenyl)-6(p-fluorophenyl)fulvene
6-(2-propenyl)-6(p-chlorophenyl)fulvene
6-methyl-6(o,p-difluorophenyl)fulvene
6-methyl-6(o,p-dichlorophenyl)fulvene
6-methyl-6(2,3,4-trifluorophenyl)fulvene
6-methyl-6(2,3,4-trichlorophenyl)fulvene
6-methyl-6(2,4,6-trifluorophenyl)fulvene
6-methyl-6(2,4,6-trichlorophenyl)fulvene and the like and mixtures of two or more thereof.

Any method known in the art may be utilized to prepare the halogenated substituted fulvenes of the present invention. Preferably, the halogenated substituted fulvenes are prepared by the condensation reaction between cyclopentadiene and either a halogenated aryl ketone or a halogenated aryl aldehyde, the general reaction mechanism being illustrated by the following equation wherein R, R′, X and n are as previously described:

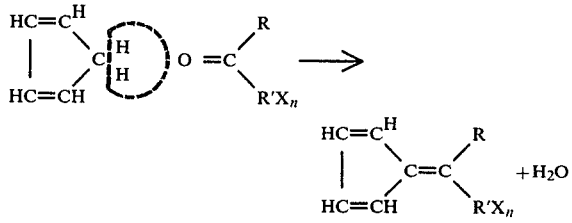

Suitable halogenated aryl ketones include o, m or p-fluoroacetophenone; o, m or p-fluoropropiophenone; o, m, or p-fluorovalerophenone; and the like and the corresponding chloro, bromo, and iodo derivatives. Suitable halogenated aryl aldehydes include o, m, or p-fluorobenzaldehyde; o, m, or p-chlorobenzaldehyde; o, m, or p-bromobenzaldehyde; o, m, or p-iodochlorobenzaldehyde and the like.

The halogenated substituted fulvenes may be combined with the fuel for an internal combustion engine by any method known in the art. Typically, the halogenated substituted fulvenes will be added to the fuel for an internal combustion engine simply by mixing the halogenated substituted fulvenes into the fuel for an internal combustion engine.

Any desired amount of the halogenated substituted fulvenes may be combined with the fuel for an internal combustion engine. Generally, the amount of the halogenated substituted fulvenes employed in the present invention will be in the range of about 0.01 molar (0.01 mole of halogenated substituted fulvenes in one liter of unleaded gasoline) to about 1 molar. Particularly good results are obtained when about 0.1 molar of the halogenated saturated fulvenes is added to the fuel for an internal combustion engine.

The following examples are presented in further illustration of the invention.

EXAMPLE I

This example describes the preparation of the compound 6-methyl-6(p-fluorophenyl)fulvene. To a 250 milliliter round bottom flask, cooled in a wet ice bath, was placed 23 grams of Amberlyst 29 (KOH treated) and 44 grams (0.66 moles) of freshly distilled cyclopentadiene. Amberlyst 29 is a KOH treated cationic exchange resin consisting mainly of sulfonated polystyrene resin available from Rohm and Haas. To this stirred, cooled (5°–10° C.) mixture was slowly added 69 grams (0.5 mole) of p-fluoroacetophenone. Stirring was maintained at the initial temperature for 2 hours after which the temperature was allowed to rise to about 25° C. while the mixture was stirred for 16–20 hours. After this time, the Amberlyst was filtered off from the colored solution and extracted (washed) with 2-100 milliliter portions of ether. The combined ether extracts were stripped of solvent and unreacted starting material. The residue was distilled through a 38.1 cm. (15 inch) Vigreaux column to yield 49.7 grams (53.3 weight percent of theoretical) of 6-methyl-6(p-fluorophenyl)fulvene distilling at 73° C./0.3 torr (mm). The distilled product was essentially 100% pure as analyzed by GLC using a 304.8 cm. (10 ft.)×0.317 cm. (0.125 in.) stainless steel column packed with 80–100 mesh 10 percent Carbowax 20M on Chromosorb P (NAW). Identification of the product was made by infrared and NMR.

EXAMPLE II

This example describes the preparation of the compound 6-methyl-6(p-chlorophenyl)fulvene. The product was prepared in the same way and in about the same yield as described in Example I but using cyclopentadiene and p-chloroacetophenone. The product, which distilled at 124° C./1 torr (mm), was identified by infrared and NMR.

EXAMPLE III

This example describes the preparation of the compound 6-ethyl-6(p-fluorophenyl)fulvene. The product was prepared in about the same yield and in the same method as described in Example I but using cyclopentadiene and p-fluoropropiophenone. The product, which distilled at 102°–103° C./1 torr (mm), was identified by infrared and NMR.

EXAMPLE IV

This example describes the evaluation of the inventive and comparative reference compounds as antiknock additives in unleaded gasoline. Antiknock activity is defined as the increase in Research Octane Number (RON) of a 0.1 molar solution of the compound to be tested in gasoline compared to the RON of the same gasoline without the additive. The RON values reported herein were determined according to a procedure outlined by the American Society of Testing and Materials titled "Standard Method of Test for Knock Characteristics of Motor Fuels by the Research Method". This method is designated as ASTM D 2699-75. The unleaded gasolines used for this test are listed in Table I. Both gasolines were used interchangeably because of similarity in properties.

TABLE I

Characteristics of Test Gasolines

| Designation | FT-116[a] | FT-175[a] |
|---|---|---|
| Rapid Vapor Pressure, psi | 7.0 | 7.2 |
| API Gravity at 60° F. (15.6° C.) | 64.4 | 64.4 |
| ASTM Distillation | | |
| Vol. % Evaporated | Temp., °F. | Temp., °F. |
| IBP | 88 | 86 |
| 5 | 113 | 115 |
| 10 | 130 | 132 |
| 15 | 143 | 145 |
| 20 | 154 | 157 |
| 30 | 176 | 178 |
| 40 | 196 | 197 |
| 50 | 214 | 213 |
| 60 | 234 | 229 |
| 70 | 252 | 250 |
| 80 | 290 | 286 |
| 90 | 347 | 353 |
| 95 | 384 | 391 |
| EP | 414 | 428 |
| Lead Content, g/gal | 0.02 | 0.005 |
| Sulfur Content, wt. % | 0.28 | 0.04 |
| Research Octane Number (RON) | 92.0 | 91.5 |
| Motor Octane Number | 84.9 | 83.9 |
| Component | Vol. % | Vol. % |
| Paraffins | 68.1 | 69.03 |
| Olefins | 16.3 | 15.01 |
| Naphthenes | 4.04 | 6.63 |
| Aromatics | 11.55 | 9.33 |
| Average Molecular Weight | 100.2 | 101.3 |
| Atomic Ratio:Hydrogen/Carbon | 2.08 | 2.10 |
| Stoichiometric Air-Fuel Ratio | 14.86 | 14.89 |

[a]Unleaded Kansas City Premium Pipeline Base Gasoline from Phillips Petroleum Co.

In Table II are listed the results of antiknock tests employing the halogenated substituted fulvene compounds and the various comparative additives. The designation ΔRON is the difference in the RON of the base gasoline and the RON of the same base gasoline with the antiknock additive. Additive compounds in groups I and II were commercially available. The nonhalogenated substituted fulvene compounds were prepared from cyclopentadiene and the corresponding aceto- or propiophenone in the manner described in Example I. The above results show that when a fluorine atom is added to toluene or aniline ($I_b$, $II_b$, $II_c$), both of which exhibit antiknock activity, the RON is decreased but when a fluorine atom is added to a substituted fulvene ($III_b$, $IV_b$) the RON is increased. The chlorine atom also increases RON as shown by comparing $III_a$ with V.

TABLE II

Effect of Fluorine Atoms on Ashless Antiknock Compounds

| | Additive Compound[1] | Chemical Structure | Δ RON |
|---|---|---|---|
| Ia. | Toluene | 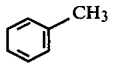 | 0.2 |
| Ib. | p-Fluorotoluene | 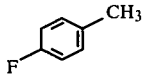 | −0.6 |
| IIa. | Aniline | 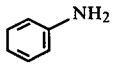 | 2.8 |
| IIb. | p-Fluoroaniline | 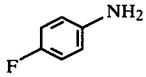 | 2.5 |
| IIc. | o-Fluoroaniline | 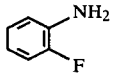 | 2.4 |
| IIIa. | 6-Methyl-6-phenyl-fulvene | 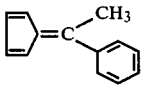 | 0.5 |
| IIIb. | 6-Methyl-6-(p-fluoro-phenyl)fulvene | 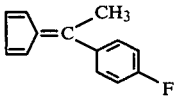 | 0.9 |
| IVa. | 6-Ethyl-6-phenyl-fulvene | 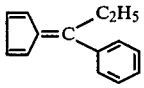 | 0.3 |
| IVb. | 6-Ethyl-6-(p-fluoro-phenyl)fulvene | 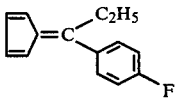 | 0.6 |
| V. | 6-Methyl-6-(p-chloro-phenyl)fulvene | 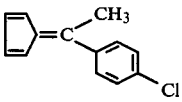 | 0.8 |

[1]0.1 Molar in 1 liter of gasoline.

Reasonable variations and modifications are possible within the scope of the disclosure and the appended claims to the invention.

That which is claimed is:

1. A method of increasing the octane number of a fuel for internal combustion engines comprising the step of adding a suitable amount of a halogenated substituted fulvene characterized by the formula

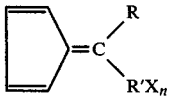

where R can be hydrogen or any hydrocarbyl radical; R′ can be any aromatic radical; X can be any halogen atom and n can be 1, 2, or 3.

2. A method in accordance with claim 1 wherein X is fluorine.

3. A method in accordance with claim 1 wherein X is chlorine.

4. A method in accordance with claim 1 wherein said substituted halogenated fulvene is 6-methyl-6-(p-fluorophenyl)fulvene.

5. A method in accordance with claim 1 wherein said halogenated substituted fulvene is 6-ethyl-6-(p-fluorophenyl)fulvene.

6. A method in accordance with claim 1 wherein said halogenated substituted fulvene is 6-methyl-6-(p-chlorophenyl)fulvene.

7. A method in accordance with claim 1 wherein said fuel for internal combustion engines is unleaded gasoline.

8. A method in accordance with claim 7 wherein said suitable amount of said halogenated substituted fulvene is in the range of about 0.01 molar to about 1 molar.

9. A method in accordance with claim 7 wherein said suitable amount of said halogenated substituted fulvene is about 0.1 molar.

10. A method in accordance with claim 1 wherein said halogenated substituted fulvene is prepared by the condensation reaction of cyclopentadiene and a halogenated aryl ketone.

11. A method in accordance with claim 1 wherein said halogenated substituted fulvene is prepared by the condensation reaction of cyclopentadiene with a halogenated aryl aldehyde.

12. A method in accordance with claim 1 wherein said hydrocarbyl radical has from 1 to 10 carbon atoms and said aromatic radical has from 6 to 10 carbon atoms.

13. A composition comprising a mixture of at least first and second components wherein said first component is a fuel for an internal combustion engine and said second component is a halogenated substituted fulvene characterized by the formula

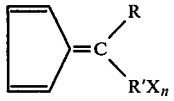

where R can be hydrogen or any hydrocarbyl radical; R′ can be any aromatic radical; X can be any halogen atom and n can be 1, 2, or 3.

14. A composition in accordance with claim 13 wherein X is fluorine.

15. A composition in accordance with claim 13 wherein X is chlorine.

16. A composition in accordance with claim 13 wherein said substituted halogenated fulvene is 6-methyl-6-(p-fluorophenyl)fulvene.

17. A composition in accordance with claim 13 wherein said halogenated substituted fulvene is 6-ethyl-6-(p-fluorophenyl)fulvene.

18. A composition in accordance with claim 13 wherein said halogenated substituted fulvene is 6-methyl-6-(p-chlorophenyl)fulvene.

19. A composition in accordance with claim 13 wherein said fuel for internal combustion engines is unleaded gasoline.

20. A composition in accordance with claim 19 wherein the amount of said halogenated substituted fulvene present in said composition is a suitable amount to improve the octane number of said fuel for an internal combustion engine.

21. A composition in accordance with claim 20 wherein said suitable amount of said halogenated substituted fulvene is in the range of about 0.01 molar to about 1 molar.

22. A composition in accordance with claim 20 wherein said suitable amount of said halogenated substituted fulvene is about 0.1 molar.

23. A composition in accordance with claim 22 wherein said halogenated substituted fulvene is prepared by the condensation reaction of cyclopentadiene and a halogenated aryl ketone.

24. A composition in accordance with claim 13 wherein said halogenated substituted fulvene is prepared by the condensation reaction of cyclopentadiene with a halogenated aryl aldehyde.

25. A composition in accordance with claim 13 wherein said hydrocarbyl radical has from 1 to 10 carbon atoms and said aromatic radical has from 6 to 10 carbon atoms.

* * * * *